US011264748B2

(12) United States Patent
McClelland, II et al.

(10) Patent No.: US 11,264,748 B2
(45) Date of Patent: Mar. 1, 2022

(54) LOW PROFILE ELECTRICAL CONNECTOR

(71) Applicant: TE CONNECTIVITY CORPORATION, Berwyn, PA (US)

(72) Inventors: Belgie Brian McClelland, II, Houston, TX (US); Jason M'Cheyne Reisinger, Carlisle, PA (US); Arash Behziz, Newbury Park, CA (US); Michael David Herring, Apex, NC (US); Eric David Briant, Dillsburg, PA (US); Michael John Phillips, Camp Hill, PA (US); Michael Joseph Tryson, Spring Grove, PA (US)

(73) Assignee: TE CONNECTIVITY SERVICES GmbH, Schaffhausen (CH)

( * ) Notice: Subject to any disclaimer, the term of this patent is extended or adjusted under 35 U.S.C. 154(b) by 17 days.

(21) Appl. No.: 16/537,852

(22) Filed: Aug. 12, 2019

(65) Prior Publication Data

US 2020/0136286 A1 Apr. 30, 2020

Related U.S. Application Data

(60) Provisional application No. 62/750,317, filed on Oct. 25, 2018.

(51) Int. Cl.

| | |
|---|---|
| ***H01R 24/00*** | (2011.01) |
| ***H01R 12/72*** | (2011.01) |
| ***H01R 12/70*** | (2011.01) |
| ***H01R 24/60*** | (2011.01) |
| ***H01R 13/04*** | (2006.01) |
| *H01R 107/00* | (2006.01) |

(52) U.S. Cl.

CPC ..... *H01R 12/725* (2013.01); *H01R 12/7082* (2013.01); *H01R 12/728* (2013.01); *H01R 13/04* (2013.01); *H01R 24/60* (2013.01); *H01R 2107/00* (2013.01); *H01R 2201/06* (2013.01)

(58) Field of Classification Search

CPC ..... H01R 23/7068; H01R 13/635; H01R 13/62938; H01R 13/633; H01R 13/64

USPC ..... 439/633, 159, 153, 157, 160, 680

See application file for complete search history.

(56) References Cited

U.S. PATENT DOCUMENTS 5,526,229 A * 6/1996 Wakabayashi ..... B41J 29/00 361/690
5,971,775 A 10/1999 Tor et al.
6,328,605 B1 * 12/2001 Walker ..... H01R 12/52 439/59

(Continued)

FOREIGN PATENT DOCUMENTS

JP 4133669 B2 8/2008

*Primary Examiner* — Phuong Chi Thi Nguyen

(57) ABSTRACT

An electrical connector that includes a housing with an interior cavity configured to receive a card. Electrical contacts are secured across a wall of the housing within the interior cavity and are configured to matingly receive corresponding electrical contacts of the card. The plurality of electrical contacts secured across the wall of the housing are the only electrical contacts of the electrical connector. Each of the plurality of electrical contacts includes a mating interface and the mating interface of each of the plurality of electrical contacts is co-planer. Additionally, the housing includes a card slot opening and each of the plurality of electrical contacts are arranged on one side of the card slot opening.

20 Claims, 8 Drawing Sheets

(56) References Cited

U.S. PATENT DOCUMENTS

| | | | | |
|---|---|---|---|---|
| 6,428,360 | B2 * | 8/2002 | Hassanzadeh | H05K 7/1431 439/159 |
| 6,575,763 | B1 * | 6/2003 | Choy | H05K 7/1431 439/64 |
| 6,695,647 | B2 | 2/2004 | Tsai | |
| 7,480,147 | B2 * | 1/2009 | Hoss | G06F 1/20 361/715 |
| 7,625,232 | B2 * | 12/2009 | Lin | H01R 12/79 439/260 |
| 8,142,207 | B1 | 3/2012 | Ljubijankic et al. | |
| 9,028,281 | B2 | 5/2015 | Kirk et al. | |

* cited by examiner

LOW PROFILE ELECTRICAL CONNECTOR

CROSS REFERENCE TO RELATED APPLICATIONS

This application claims benefit to U.S. Provisional Application No. 62/750,317, filed Oct. 25, 2018, titled "LOW PROFILE ELECTRICAL CONNECTOR", the subject matter of which is herein incorporated by reference in its entirety.

BACKGROUND OF THE INVENTION

The subject matter herein relates generally to electrical connectors.

Communication systems exist today that utilize electrical connectors to transmit data. For example, network systems, servers, data centers, and the like may use numerous electrical connectors to interconnect the various devices of the communication system. Many electrical connectors include signal conductors and ground conductors in which the signal conductors convey data signals and the ground conductors reduce crosstalk and/or electromagnetic interference (EMI) between the signal conductors.

As communication systems continue to decrease in size, there is increased demand to decrease the size of all electrical components, including electrical connectors. By reducing the size of the electrical connectors, spatial constraints are minimized allowing for greater design choices for custom and new communication systems.

Accordingly, there is a need for electrical connectors that improve spatial characteristics while maintaining robustness, performance, and/or expense.

BRIEF DESCRIPTION OF THE INVENTION

In an embodiment, an electrical connector is provided including a housing with an interior cavity configured to receive a card, and a plurality of electrical contacts secured across a wall of the housing within the interior cavity and configured to matingly receive corresponding electrical contacts of the card. The plurality of electrical contacts secured across the wall of the housing are the only electrical contacts of the electrical connector. Each of the plurality of electrical contacts includes a mating interface and the mating interface of each of the plurality of electrical contacts is co-planer. Additionally, the housing includes a card slot opening and each of the plurality of electrical contacts are arranged on one side of the card slot opening.

In another embodiment, an electrical device is provided that includes a heat sink and a substrate secured to the heat sink to convey heat from the substrate to the heat sink. An electrical connector is also provided that includes a housing having a plurality of electrical connectors therein configured to matingly receive a card. The electrical connector is secured between the substrate and the heat sink.

In another embodiment, an electrical connector is provided that includes a housing with an interior cavity configured to receive a card having a first electrical component on a first surface and a second electrical component on a second surface. A plurality of electrical contacts are secured across a wall of the housing within the interior cavity and configured to matingly receive corresponding electrical contacts of the card. The housing also includes a top wall with a height that is equal to or less than a height of the electrical component on the first surface of the card and a bottom wall with a height that is equal to or less than a height of the electrical component on the second surface of the card.

DETAILED DESCRIPTION OF THE INVENTION

Embodiments set forth herein may include various electrical connectors that are configured for communicating data signals. The electrical connectors may mate with a corresponding mating connector to communicatively interconnect different components of a communication system. In the illustrated embodiment, the electrical connector is a plug connector, which may be terminated to and electrically coupled to another electrical component, such as a circuit board, a wire harness or another electrical component. The plug connector may be a pluggable input/output (I/O) connector, which may be mated with a corresponding receptacle connector during a mating operation. It should be understood, however, that the inventive subject matter set forth herein may be applicable in other types of electrical connectors.

In various embodiments, the electrical connectors provide low profile connectors including electrical connectors with electrical contacts on only one wall of an interior cavity of the electrical connector housing. Exemplary electrical connectors provide electrical connector housing that aligns with electrical components on a card inserted into the housing. Exemplary electrical connectors also allow a compression fit between a heat sink and a printed circuit board (PCB). In other exemplary embodiments quad small form factor pluggable double density QSFP-DD type connectors are provided including with electrical contacts that result in a low-profile spatial connector.

Figure 1:
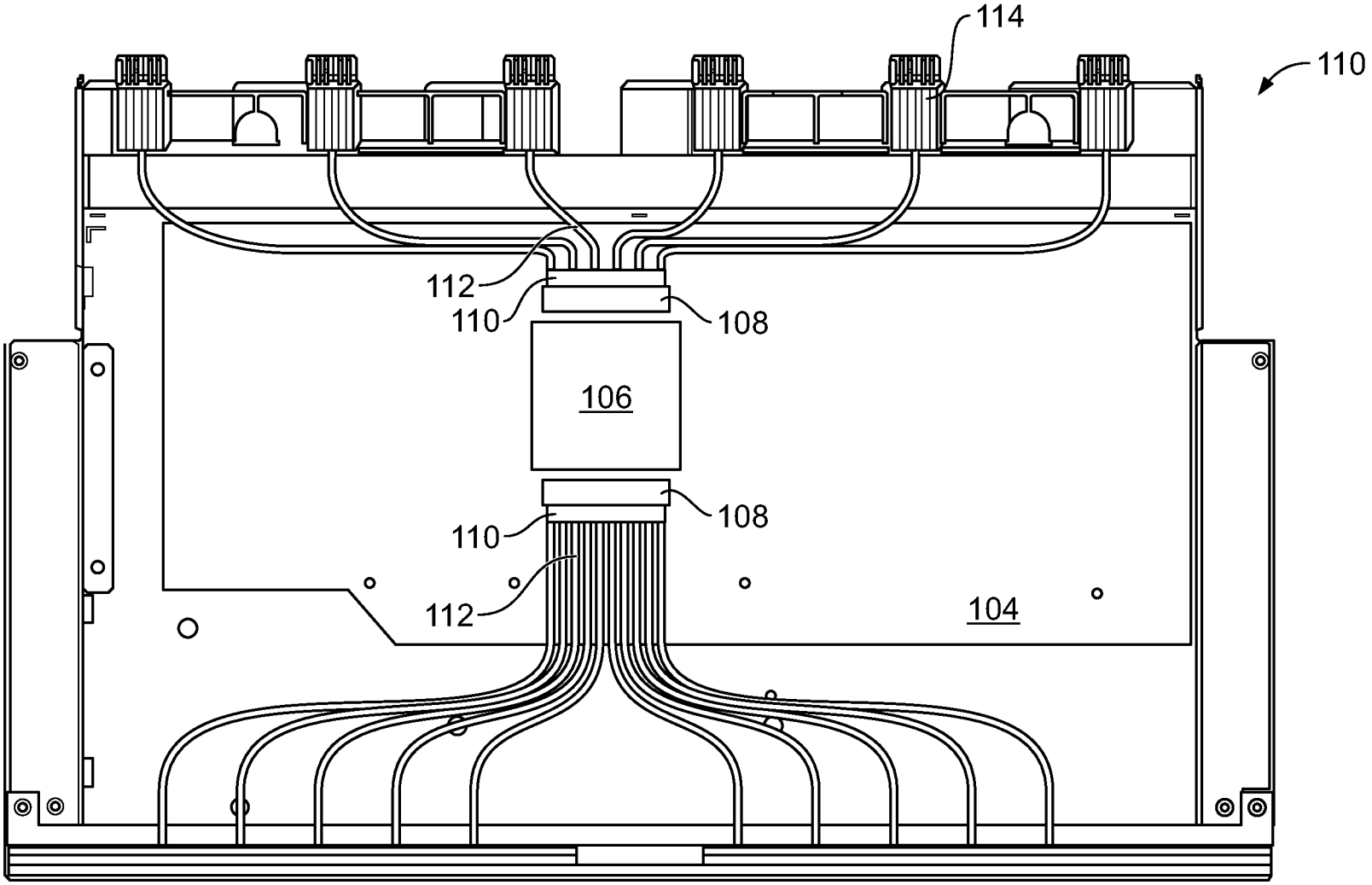
FIG. 1 is a top plan view of an electrical device in accordance with an exemplary embodiment.
Figure 2:
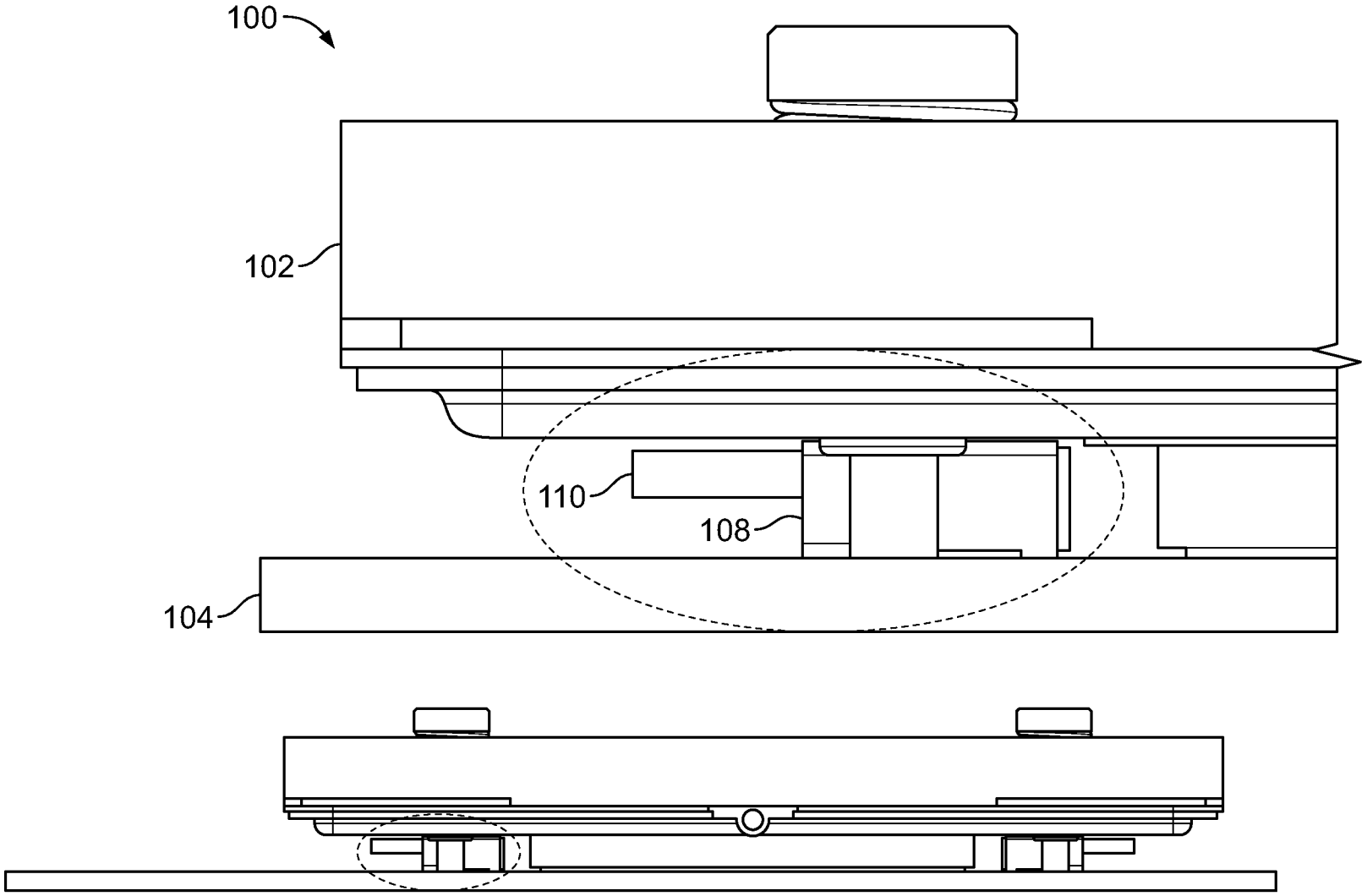
FIG. 2 is a side plan view of an electrical device in accordance with an exemplary embodiment.

FIG. 1 is a perspective view of an electrical device 100 formed in accordance with an embodiment. FIG. 2 is a side plan illustration of the electrical device 100 in accordance with an embodiment. FIGS. 1-2 illustrate an electrical device 100 that includes a heat sink 102, a substrate 104 on the heat sink 102 that in one example is a PCB, an application specific integrated circuit (ASIC) 106 electrically connected on the substrate 104, electrical connectors 108 that receive cards 110, communication cables 112 electrically connected to the cards 110, and communication conduits 114 coupled to the communication cables 112.

In this exemplary embodiment, the electrical connectors 108 present two low-profile electrical connectors 108 adjacent the ASIC 106 such that each electrical connector 108 is disposed between the heat sink 102 and substrate 104. In one example, the electrical connector 108 is 4 mm or less. In another example, the electrical connector 108 has a height in a range between about 3 mm and about 4 mm. Thus, the card 110 is able to be inserted into the electrical connector 108 parallel to the substrate 104 to provide an electrical connection between the card 110 and the substrate 104 underneath the heat sink 102. In this manner the electrical connector 108 provides a right-angle connection to the substrate 104. In one embodiment, when the heat sink 102 and substrate 104 are coupled, the heat sink 102 and substrate 104 provide a frictional fit with the electrical connector 108 by engaging the electrical connector 108 providing a compression force on the electrical connector 108. This compression force thus holds the electrical connector 108 and card 110 in place and minimizes vibration on the card 110 for improved functioning of the electrical device 100. The card 110 is of any type, including a personal computer (PC) card, smart card, a personal computer memory card, or the like.

Figure 3:
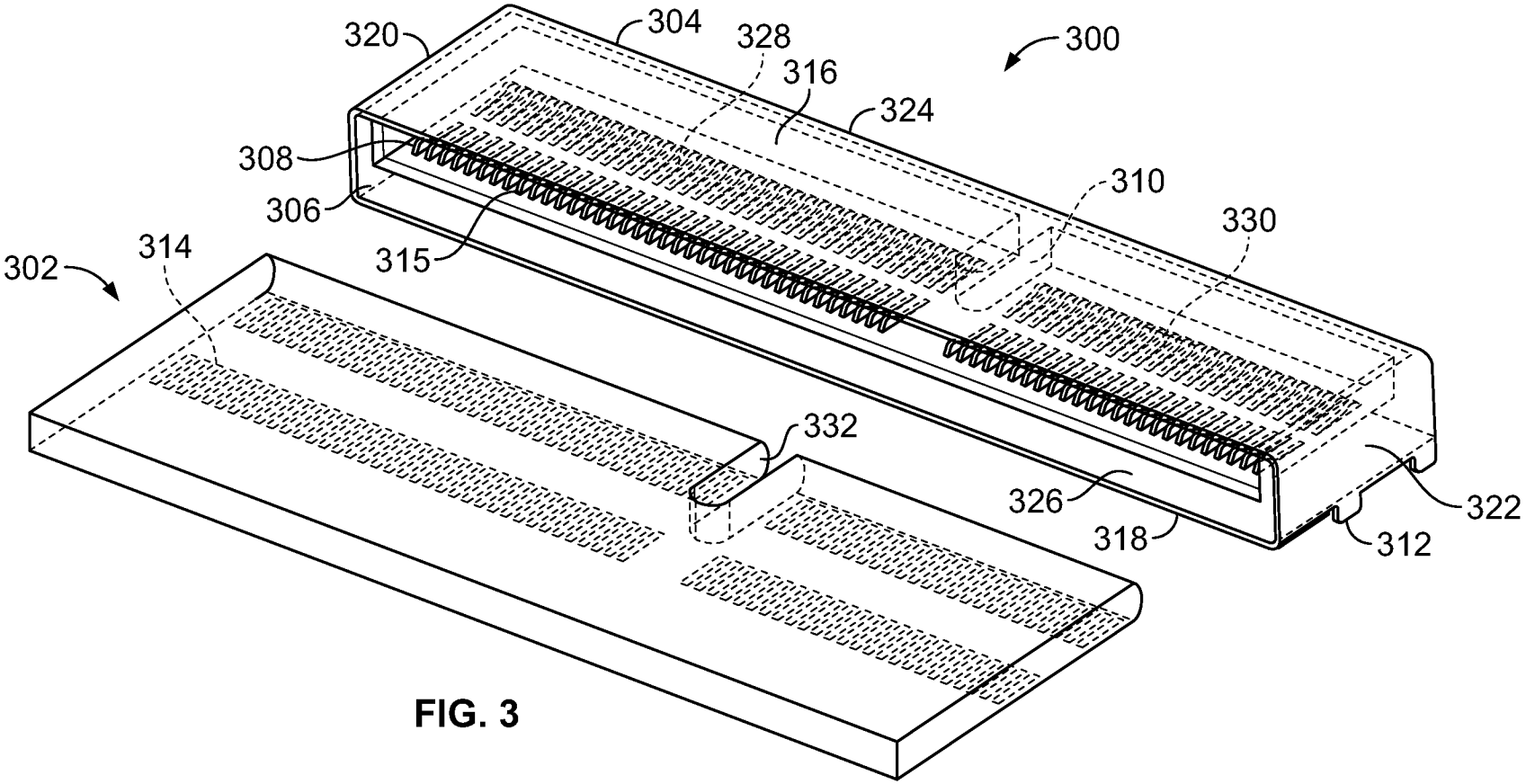
FIG. 3 is an exploded perspective view with hidden lines of an electrical connector in accordance with an exemplary embodiment.

FIG. 3 illustrates an exemplary low-profile electrical connector 300 in combination with a card 302. In one embodiment the electrical connector 300 is the electrical connector 108 of FIGS. 1-2 and the card 302 is the card 110 of FIGS. 1-2. The electrical connector 300 includes a housing 304, an interior cavity 306, a plurality of electrical contacts 308 within the interior cavity 306, a stop element 310, and mounting tabs 312. The card 302 includes a plurality of electrical contacts 314 that each mate with a corresponding electrical contact 308 of the electrical connector 300 to provide an electrical connection and communication path between the electrical connector 300 and card 302. The electrical contacts 314 of the card 302 may include traces, pads, or the like. Specifically, the plurality of electrical contacts 308 include a mating interface 315 that mates with the electrical contacts 314 and the mating interface 315 of each of the plurality of electrical contacts 308 in one example are co-planer.

The housing 304 includes a top wall 316, opposing bottom wall 318, opposing side walls 320, 322, and a back wall 324 that form the interior cavity 306. In this manner the housing 304 includes an opening 326 for receiving the card 302. The plurality of electrical contacts 308 are secured across a wall within the interior cavity 306. In one example embodiment, the bottom wall 318 receives the plurality of electrical contacts 308. In another example embodiment, the top wall 316 receives the plurality of electrical contacts 308. In each embodiment, electrical contacts are only presented on one wall 316 or 318 of interior cavity 306 of the housing. Thus, the plurality of electrical contacts 308 are configured to be positioned either only below the card 302 or above the card 302. By having electrical contacts 308 on only one wall 316 or 318, the height of the housing is decreased improving spatial characteristics of the electrical connector 300.

The plurality of electrical contacts 308 of the electrical connector 300 in one example include a first section 328 and a second section 330 that are spaced from one another. In such an embodiment, the stop element 310 is disposed between the first section 328 and second section 330 and receives a slot 332 of the card 302. Consequently, the stop element 310 resists lateral movement of the card 302. In one example the stop element 310 is offset between the side walls 320, 322 of the interior cavity 306 to ensure the card 302 can only be inserted in one manner, preventing improper insertion of the card 302. In other embodiments the stop element 310 is removed and the electrical contacts 308 are only in one section. Alternatively, in other embodiments, additional stop elements extend from the back wall 324. Meanwhile, the mounting tabs 312 are configured to engage and couple to a substrate, such as the substrate 104 of FIGS. 1-2, or a PCB.

Figure 4:
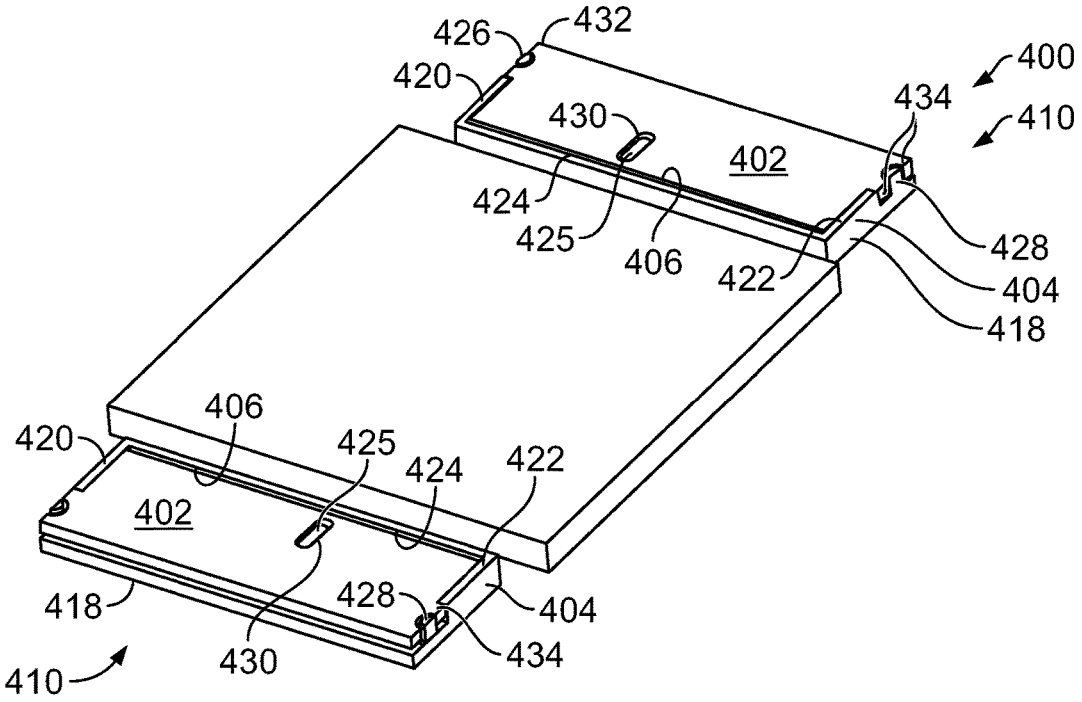
FIG. 4 is an exploded perspective view of an electrical connector in accordance with an exemplary embodiment.
Figure 5:
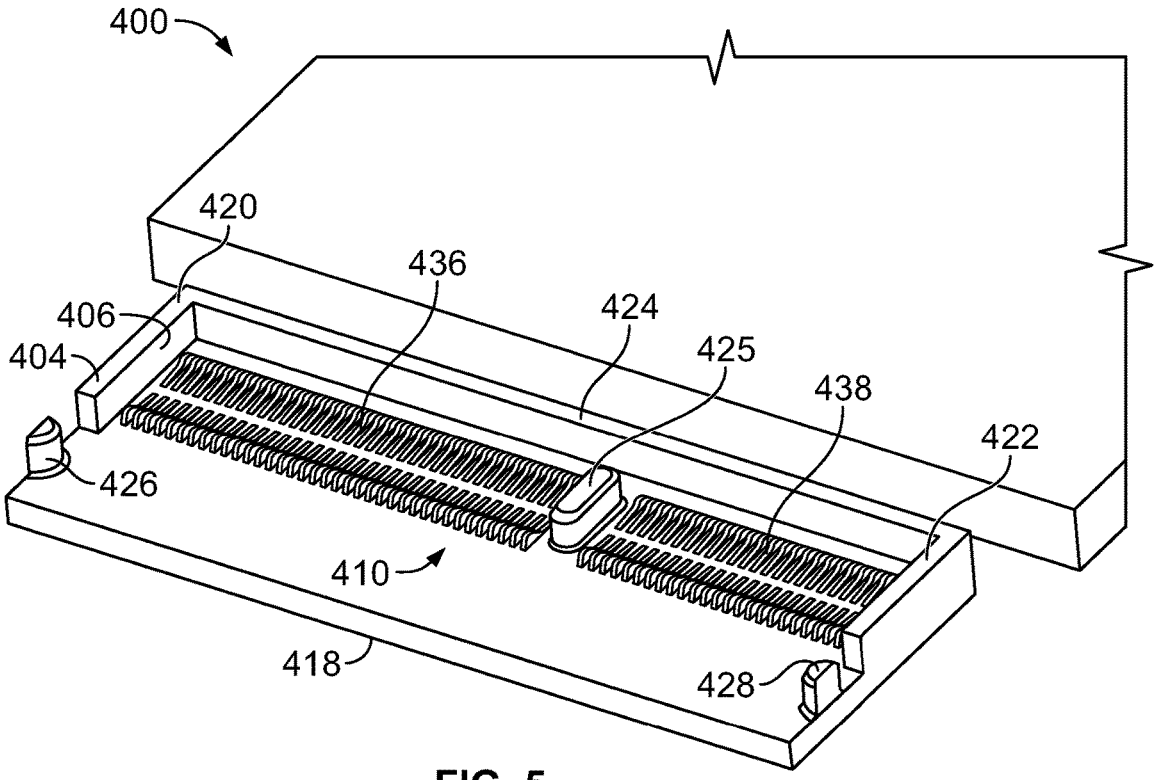
FIG. 5 is a perspective view of an electrical connector in accordance with an exemplary embodiment.

FIGS. 4-5 illustrate another exemplary low-profile electrical connector 400 in combination with a card 402. In one embodiment the electrical connector 400 is the electrical connector 108 of FIGS. 1-2 and the card 402 is the card 110 of FIGS. 1-2. The electrical connector 400 includes a housing 404, an interior cavity 406, a plurality of electrical contacts 408 within the interior cavity 406, and stop elements 410. The card 402 includes a plurality of electrical contacts (not shown) that each mate with a corresponding electrical contact 408 of the electrical connector 400 to provide an electrical connection and communication path between the electrical connector 400 and card 402.

The housing 404 includes an open top, a bottom wall 418, opposing side walls 420, 422, and a back wall 424 that form the interior cavity 406. The opposing side walls 420, 422 extend from the back wall 424 and terminate prior to the termination of the bottom wall 418. Specifically, the stop elements 410 include a first stop element 425 extending from adjacent the back wall 424, and opposing second and third stop elements 426, 428 extending adjacent the side walls 420, 422. Meanwhile, the card 402 includes a slot 430 disposed therethrough that mates with the first stop element 425, and first set of teeth members 432 that mate with the second stop element 426 and a second set of teeth members 434 that mate with the third stop element 428. In this manner the housing 404 receives the card 402 within the interior cavity 406 to prevent lateral movement of the card 402. Additionally, as a result of the placement of the stop elements 410, the card 402 may only be inserted into the electrical connector 400 in one manner, preventing the misplacement of the card 402. In addition, by removing the top wall, the height of the electrical connector 400 is reduced improving spatial characteristics.

The plurality of electrical contacts 408 are secured across a wall within the interior cavity 406. In one example embodiment, the plurality of electrical contacts 408 is received by the bottom wall 418. Thus, the plurality of electrical contacts 408 are only presented on one wall 418 of interior cavity 406 of the housing. By having electrical contacts 408 on only one wall 418, the height of the housing is decreased improving spatial characteristics of the electrical connector 400. Similarly, in this embodiment, this allows the top wall to be removed, again reducing the height of the electrical connector 400 as described above. Therefore, in one example, when the connector 400 is placed on a substrate adjacent an ASIC as illustrated in in the example of FIGS. 1-2, height from the bottom wall to the top wall is equal to or less than the height of the ASIC from a bottom surface to a to surface.

The plurality of electrical contacts 408 of the electrical connector 400 in one example also include a first section 436 and a second section 438 that are spaced from one another similar to the example embodiment of FIG. 3. In such an embodiment, the first stop element 425 is disposed between the first section 436 and second section 438. Still, in other embodiments the first stop element 425 is removed and the electrical contacts 408 are only in one section. Alternatively, in other embodiments additional stop elements extend from the back wall 424.

Figure 6:
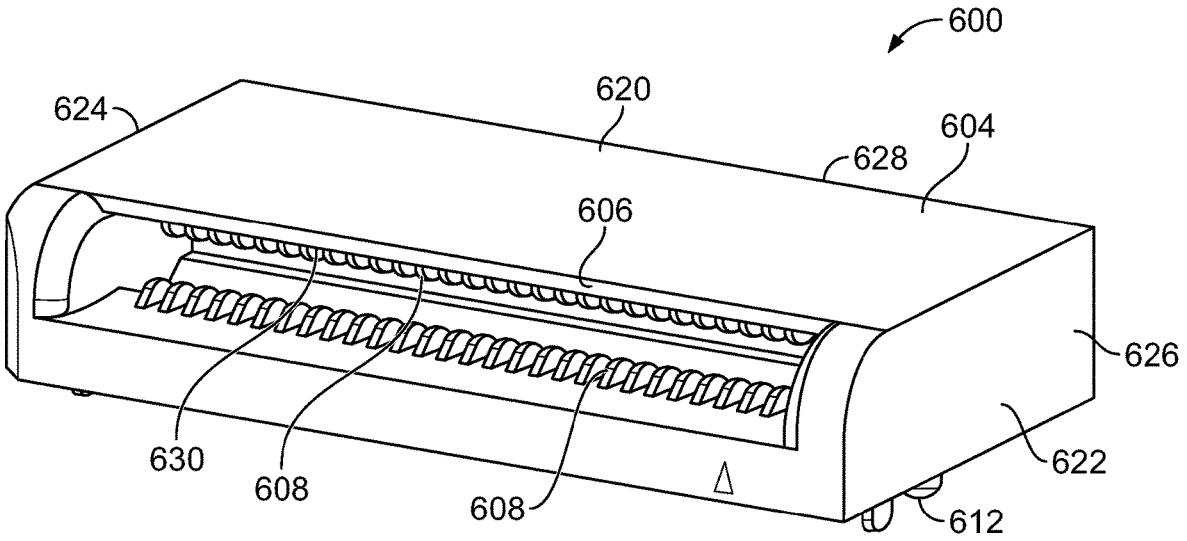
FIG. 6 is a perspective view of an electrical connector in accordance with an exemplary embodiment.
Figure 7:
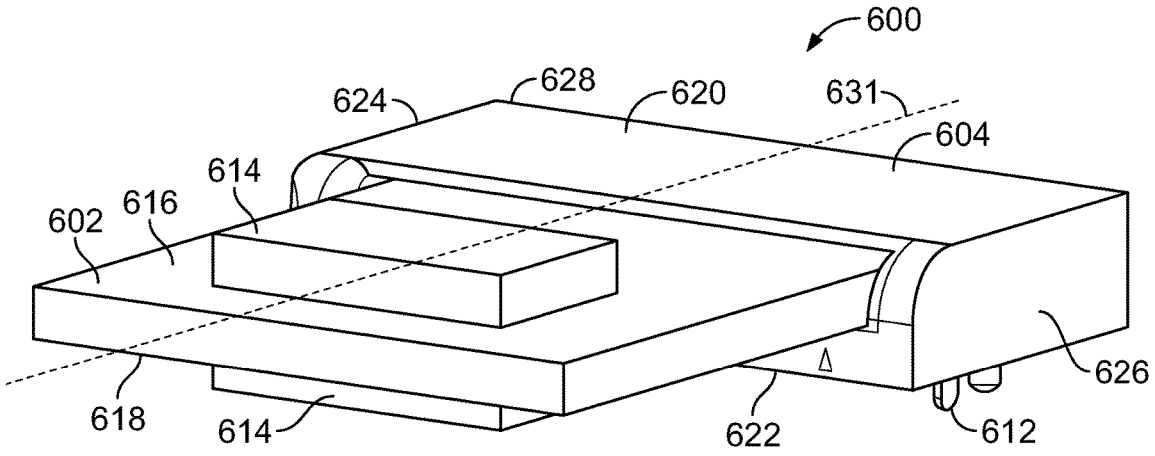
FIG. 7 is a perspective view of an electrical connector in accordance with an exemplary embodiment.
Figure 8:
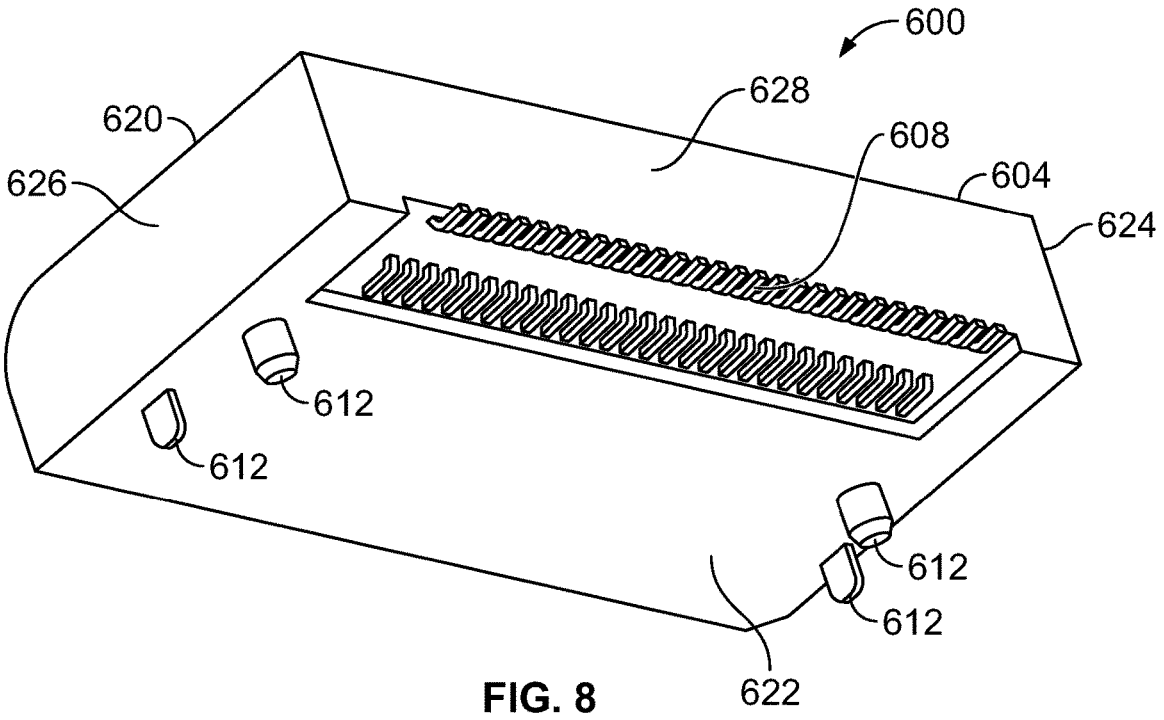
FIG. 8 is a perspective view of an electrical connector in accordance with an exemplary embodiment.
Figure 9:
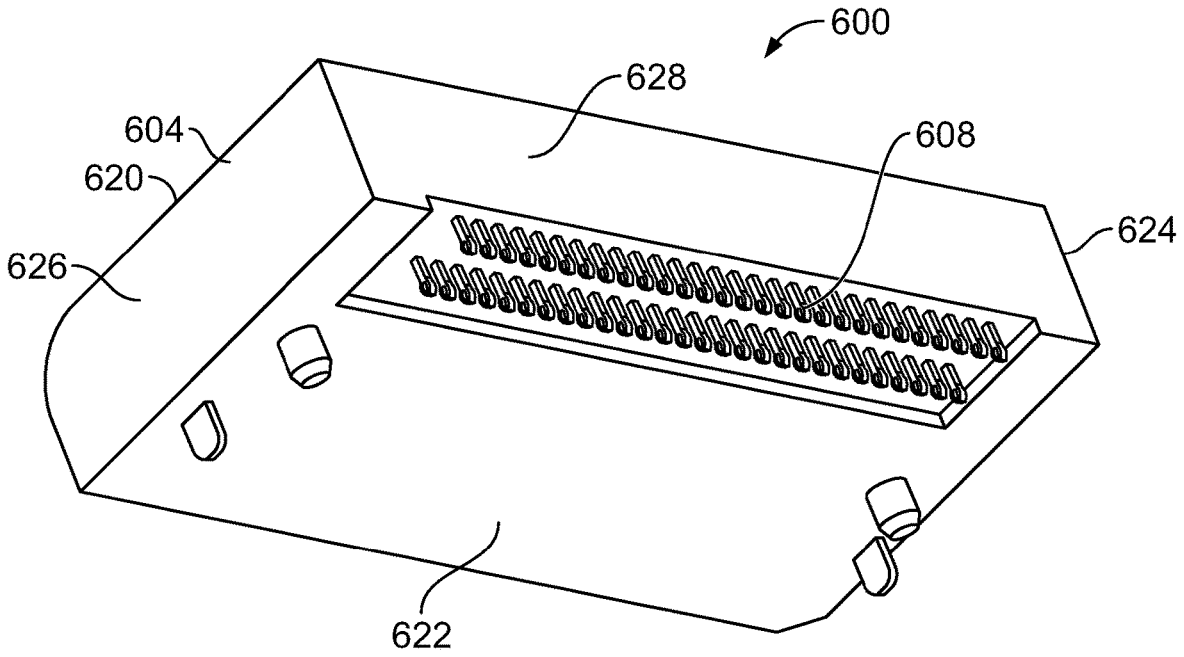
FIG. 9 is a perspective view of an electrical connector in accordance with an exemplary embodiment.

FIGS. 6-9 illustrate exemplary embodiments of low profile electrical connectors that have a quad small form factor pluggable double density QSFP-DD form factor. FIGS. 6-7 illustrate the front side of one such exemplary embodiment, while FIGS. 8-9 illustrate optional bottom and back sides of the exemplary electrical connector of FIGS. 6-7.

FIGS. 6-7 illustrate the electrical connector 600 in combination with a card 602. In one embodiment the electrical connector 600 is the electrical connector 108 of FIGS. 1-2 and the card 602 is the card 110 of FIGS. 1-2. The electrical connector 600 includes a housing 604, an interior cavity 606, a plurality of electrical contacts 608 within the interior cavity 606, and mounting tabs 612. The card 602 includes a plurality of electrical contacts (not shown) that each mate with a corresponding electrical contact 608 of the electrical connector 600 to provide an electrical connection and communication path between the electrical connector 600 and card 602.

The card 602 is illustrated with electrical components 614 on a top surface 616 and a bottom surface 618. The housing 604 includes a top wall 620, opposite bottom wall 622, opposing side walls 624, 626, and a back wall 628. The housing 604 is configured to include an opening 630 that is centrally located in the front of the housing 604 such that in one embodiment the top wall 620 is the same height or of lesser height than a top surface 616 of the electrical component 614 on the top surface 616 of the card 602. In another embodiment, the housing 604 is configured to include an opening 630 that is centrally located in the front of the housing 604 such that the bottom wall 622 is the same height or of lesser height than a bottom surface of the electrical component 614 on the bottom surface 618 of the card 602. Alternatively, the housing 604 is configured to include an opening 630 that is centrally located in the front of the housing 604 such that the top wall 620 is the same height or of lesser height than the top surface of the electrical component 614 on the top surface 616 of the card 602, while the bottom wall 622 is the same height or of lesser height than a bottom surface of the electrical component 614 on the bottom surface 618 of the card 602.

The plurality of electrical contacts 608 are secured across a wall within the interior cavity 606. In one example, the electrical contacts 608 are only disposed on the top wall 620 of the housing to reduce height of the housing 604. In another embodiment the electrical contacts 608 are only disposed on the bottom wall 622 of the housing 604, again to reduce height of the housing 604. Alternatively, electrical contacts 608 are disposed on both the top wall 620 and bottom wall 622 of the housing 604 and the opening 630 is configured to include an opening 630 that is centrally located in the front of the housing 604 such that the top wall 620 is the same height or of lesser height than the top surface of the electrical component 614 on the top surface 616 of the card 602. Specifically, the top surface of the top wall 620 is at or below a plane 631 formed by a top surface of the electrical component 614 on the top surface 616 of the card 602. Thus, spatial characteristics are improved to allow for more design flexibility.

FIG. 8 illustrates an exemplary embodiment of the bottom wall 622 and back wall 628 of the electrical connector 600. In this embodiment, the mounting tabs 612 are provided to present a surface mount technology (SMT) electrical connector 600. FIG. 9 meanwhile presents an exemplary embodiment of the bottom wall 622 and back wall 628 of the electrical connector 600 where the mounting tabs 612 are provided to present a through hole/PSS socket mount electrical connector 600. Thus, the electrical connector 600 may provide the spatial advantages and accommodate different mounting configurations.

Figure 10:
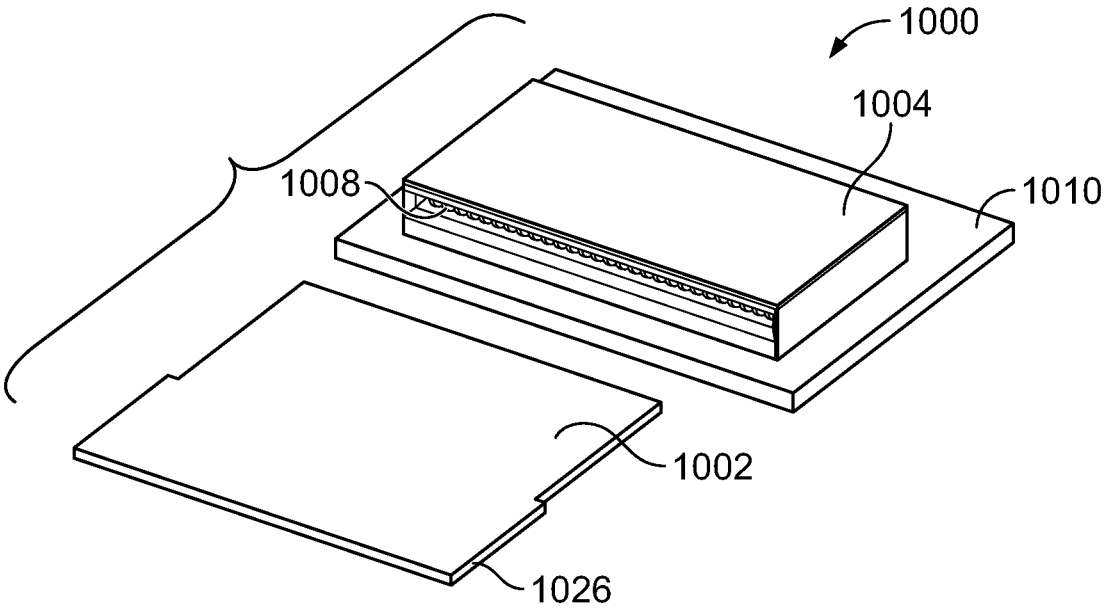
FIG. 10 is an exploded perspective view of an electrical connector in accordance with an exemplary embodiment.
Figure 11:
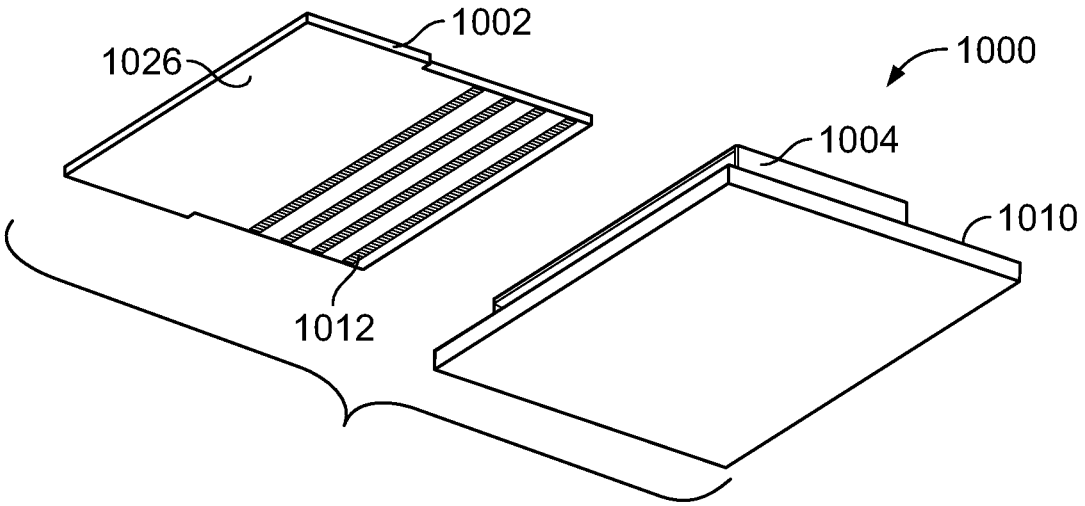
FIG. 11 is an exploded perspective view of an electrical connector in accordance with an exemplary embodiment.
Figure 12:
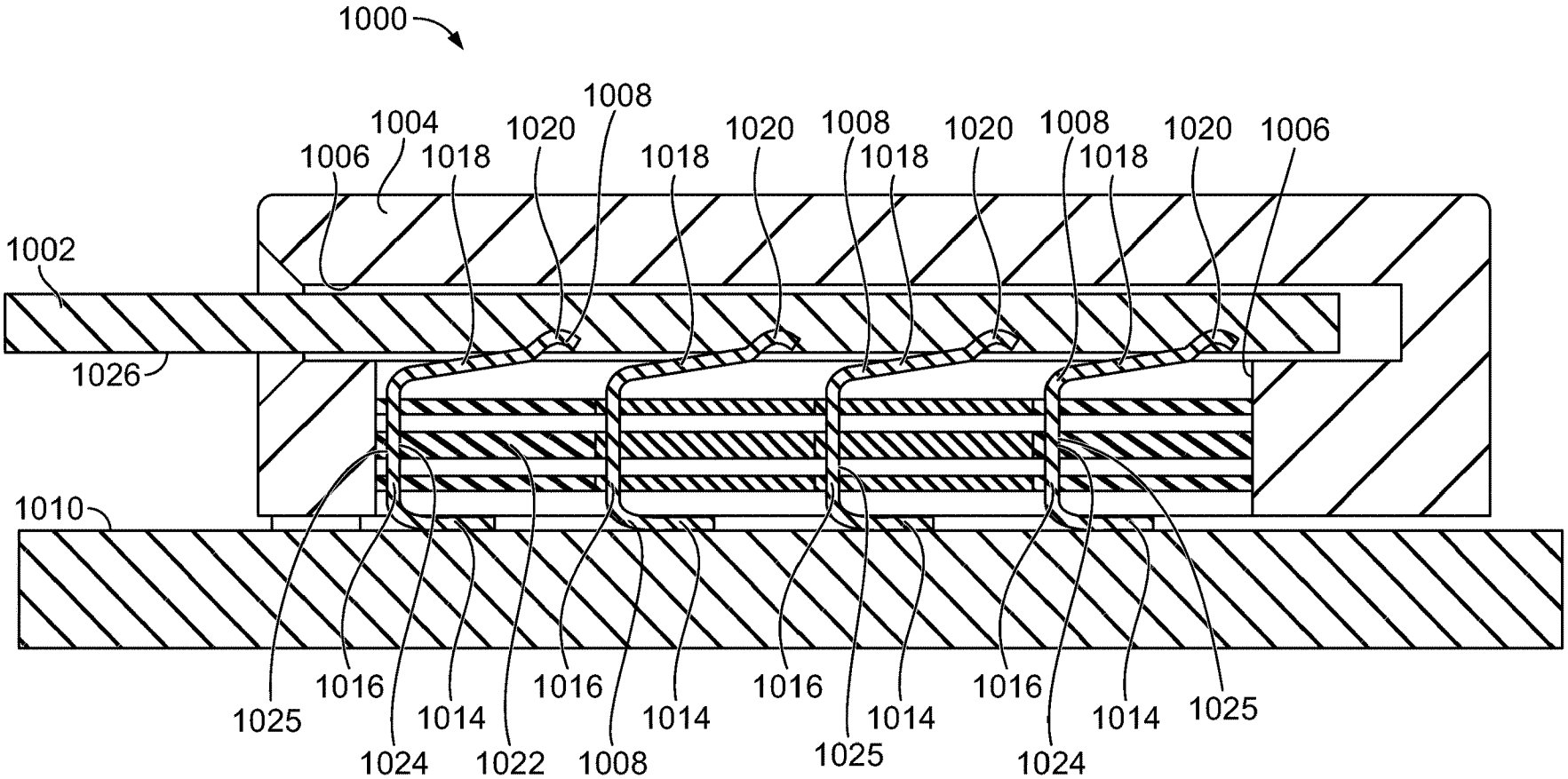
FIG. 12 is a side sectional view of an electrical connector in accordance with an exemplary embodiment.

FIGS. 10-12 illustrate another exemplary embodiment of low profile electrical connector that has a QSFP-DD form factor. FIGS. 10-12 illustrate the electrical connector 1000 in combination with a card 1002. In one embodiment the electrical connector 1000 is the electrical connector 108 of FIGS. 1-2 and the card 1002 is the card 110 of FIGS. 1-2. The electrical connector 1000 includes a housing 1004, an interior cavity 1006, and a plurality of electrical contacts 1008 within the interior cavity 1006. FIGS. 10-12 also illustrate a substrate 1010, that in one example embodiment is a PCB, to illustrate the how the electrical contacts 1008 of the electrical connector 1000 are positioned within the electrical connector 1000 to reduce the profile, or height of the housing 1004 of the electrical connector 1000. The card 1002 includes a plurality of electrical contacts 1012 that each mate with a corresponding electrical contact 1008 of the electrical connector 1000 to provide an electrical connection and communication path between the electrical connector 1000 and card 1002. The electrical contacts 1012 of the card 1002 may include traces, pads, or the like.

With reference to FIG. 12 four separate rows of electrical contacts 1008 are illustrated. In one example these rows of electrical contacts 1008 are co-planer with one another. In another example, additional rows of electrical contacts 1008 are included to increase the number of high speed transmission lanes. Similarly, more lanes can be added across a row as well. Each electrical contact 1008 includes a terminating section 1014 that engages the substrate 1010 and extends into a vertical section 1016 upwardly toward the portion of the interior cavity 1006 retaining the card 1002. A mating section 1018 extends from the vertical section 1016 away from the vertical section 1016 and away from the terminating section 1014 to an arcuate section 1020 that engages and couples to the card 1002. In an example embodiment the electrical contacts 1008 are held in place by a retaining member 1022 that has contact channels 1024 that each receive a vertical section 1016 of a corresponding electrical contact 1008. Specifically, the retaining member 1022 includes openings 1025 that the vertical section 1016 of the electrical contacts 1008 are deposed through to retain each electrical contact 1008 in place and resist horizontal movement. The retaining member 1022 is secured to housing 1004 on both ends to provide this supporting structure for the electrical contacts 1008.

In this embodiment, the electrical contacts 1008 only engage and couple to a single surface of the card 1002 where in this embodiment that surface is the bottom surface 1026 of the card 1002. So, in the example embodiment of FIG. 12, by placing all four rows of electrical contacts 1008 between only one side of the card 1002 and the substrate 1010, spatial characteristics are improved. Additionally, in one example, each of the electrical contacts is the same length, and a length that is reduced. This results in the electrical path between the card 1002 and a solder joint on the substrate 1010 is significantly reduced, reducing moment forces on the solder joint and improving signal integrity. Thus, spatial characteristics are improved while improving signal integrity over other QSFP-DD form connectors.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. § 112(f), unless and until such claim limitations expressly use the phrase "means for" followed by a statement of function void of further structure.

What is claimed is:

1. An electrical connector, comprising:

a housing including an interior cavity configured to receive a card, the housing having a top and a bottom, the bottom configured to be mounted to a substrate;

a plurality of electrical contacts secured across a wall of the housing within the interior cavity and configured to matingly receive corresponding electrical contacts of the card;

wherein the plurality of electrical contacts secured across the wall of the housing are the only electrical contacts of the electrical connector;

wherein each of the plurality of electrical contacts includes a mating interface; wherein the mating interface of each of the plurality of electrical contacts is co-planer; and wherein the housing includes a card slot opening receiving the card and the card slot opening being open at the top of the housing, each of the plurality of electrical contacts are arranged on one side of the card slot opening to mate with one the electrical contacts of the card on one side of the card, the housing configured to receive the card with the card oriented parallel to the bottom of the housing.

2. The electrical connector of claim 1, wherein the housing is four millimeters or less in height.

3. The electrical connector of claim 1, wherein the electrical connector is a surface mount technology connector or a through hole socket mount electrical connector.

4. The electrical connector of claim 1, further comprising a stop element on the wall of the housing and configured to prevent movement of the card.

5. The electrical connector of claim 1, wherein the wall is a bottom wall of the housing such that the plurality of electrical contacts are configured to be positioned below the card.

6. The electrical connector of claim 5, wherein the card slot opening is above the bottom wall and configured to receive the card.

7. The electrical connector of claim 1, further comprising:

a first stop element on the wall of the housing configured to be received by an opening within the card;

a second stop element configured to receive the card; and a third stop element configured to receive the card.

8. The electrical connector of claim 7, wherein the housing includes a first sidewall adjacent the first stop element, and a second sidewall adjacent the second stop element.

9. The electrical connector of claim 1, wherein the plurality of electrical contacts include at least one electrical contact that comprises:

a terminating section configured to engage and extend along a substrate;

a vertical section extending from the terminating section; and a mating section extending from the vertical section to an arcuate section configured to bias against the card.

10. The electrical connector of claim 9 wherein the substrate is a printed circuit board (PCB).

11. The electrical connector of claim 9, wherein each of the electrical contacts of the plurality of electrical contacts is the same length.

12. An electrical device comprising:

a substrate having an electrical component mounted to an upper surface of the substrate;

a heat sink coupled to one of the substrate or electrical component to interface with an upper surface of the electrical component to dissipate heat from the electrical component;

an electrical connector mounted to the upper surface of the substrate proximate to the electrical component, the electrical connector including a housing having a plurality of electrical contacts therein being electrically connected to the electrical component through the substrate, the housing having a cavity configured to matingly receive a card, the electrical contacts arranged in the cavity to electrically connect to the card, the electrical contacts electrically connecting the card with the electrical component; and wherein the electrical connector is coupled to the substrate between the upper surface of the substrate and a bottom of the heat sink to position the card in a space between the upper surface of the substrate and the bottom of the heat sink.

13. The electrical device of claim 12, wherein the electrical component is an application specific integrated circuit (ASIC) having a bottom surface secured to the substrate and a top surface engaging the heat sink, the ASIC having a height from the bottom surface to the top surface, wherein the height of the electrical connector is equal to or less than the height of the ASIC.

14. The electrical device of claim 12, wherein the substrate is a printed circuit board (PCB).

15. The electrical device of claim 12, wherein the electrical connector is four millimeters or less in height.

16. The electrical device of claim 12, wherein the plurality of electrical contacts include at least one electrical contact that comprises:

a terminating section configured to engage and extend along a substrate;

a vertical section extending from the terminating section; and a mating section extending from the vertical section to an arcuate section configured to bias against the card.

17. A electrical connector comprising:

a housing including an interior cavity configured to receive a card having a first electrical component on a first surface and a second electrical component on a second surface, the housing including a bottom configured to be mounted to a substrate, the interior cavity receiving the card with the card oriented parallel to the bottom;

a plurality of electrical contacts secured to a wall within the interior cavity of the housing and configured to matingly receive corresponding electrical contacts of the card; and wherein the housing includes a top wall having a top surface wherein the top surface of the top wall is at or below a plane formed by a top surface of the first electrical component, and wherein the top surface of the top wall is at or above a plane formed by the first surface of the card.

18. The electrical connector of claim 17, wherein electrical contacts of the plurality of electrical contacts are secured to the top wall of the housing within the interior cavity and electrical contacts of the plurality of electrical contacts are secured to a bottom wall of the housing within the interior cavity.

19. The electrical connector of claim 17, wherein the electrical connector is a surface mount technology connector or a through hole socket mount electrical connector.

20. The electrical connector of claim 17, wherein the housing is four millimeters or less in height.

* * * * *